US006652045B1

(12) United States Patent
Jungkind

(10) Patent No.: US 6,652,045 B1
(45) Date of Patent: Nov. 25, 2003

(54) SUPPORT DEVICE FOR A GOLF BAG

(75) Inventor: Roland Jungkind, Garmisch-Partenkirchen (DE)

(73) Assignee: MS-Trade GmbH & Co., Munich (DE)

( * ) Notice: Subject to any disclaimer, the term of this patent is extended or adjusted under 35 U.S.C. 154(b) by 0 days.

(21) Appl. No.: 09/961,520

(22) Filed: Sep. 24, 2001

Related U.S. Application Data

(63) Continuation-in-part of application No. 09/798,630, filed on Mar. 1, 2001.

(30) Foreign Application Priority Data

Mar. 5, 2000 (DE) ..... 100 10 168
Sep. 23, 2000 (DE) ..... 100 47 798

(51) Int. Cl.[7] ..... A63B 55/00
(52) U.S. Cl. ..... 306/315.7; 248/96
(58) Field of Search ..... 206/315.7, 315.3, 206/315.6; 248/96; 211/70.2, 70.5, 60.1, 69.5; 280/DIG. 5, DIG. 6

(56) References Cited

U.S. PATENT DOCUMENTS

| | | | | |
|---|---|---|---|---|
| 1,693,889 A | | 12/1928 | Dick | |
| 1,774,557 A | | 1/1930 | Kuntz | |
| 1,865,689 A | | 7/1932 | Hansen et al. | |
| 1,890,362 A | | 12/1932 | Bellow | |
| 1,920,581 A | | 8/1933 | Murphy et al. | |
| 1,954,413 A | | 4/1934 | Hunter | |
| 2,016,967 A | | 10/1935 | Komers | |
| 2,661,174 A | | 12/1953 | Sands | |
| 4,226,389 A | | 10/1980 | Neth | |
| 4,778,136 A | | 10/1988 | Reimers | |
| 4,949,844 A | | 8/1990 | Yang | |
| 5,339,951 A | * | 8/1994 | Chen | 206/315.7 |
| 5,390,788 A | * | 2/1995 | Schenkkan | 206/315.7 |
| 5,605,310 A | * | 2/1997 | Jungkind | 248/96 |

FOREIGN PATENT DOCUMENTS

| | | |
|---|---|---|
| DE | 43 27 289 C2 | 2/1995 |
| EP | 0 638 340 A1 | 8/1994 |

* cited by examiner

*Primary Examiner*—Lee Young
*Assistant Examiner*—Lien M Ngo
(74) *Attorney, Agent, or Firm*—D. Peter Hochberg; Sean Mellino; Katherine R. Vieyra

(57) ABSTRACT

A golf bag assembly including supporting legs movable between a support position for cooperating with the bag to hold the golf bag assembly in an upright position and a transport position wherein the legs are parallel to the longitudinal axis of the bag, a pull member assembly for moving the supporting legs, and an operating member for movement over a dead center position for controlling movement of the supporting legs between the support position and the transport position. A stop member can be provided for selectively allowing or preventing the operating member from assuming a closed position for releasably locking the supporting legs in the transport position. A transmission system for connecting the operating assembly and a pivot assembly for effecting movement of the supporting legs can extend across and through the golf bag so as not to expand the width of the golf bag. A stiffening ring assembly can be provided for incorporating the supporting legs pivot assembly, the operating assembly and the transmission system. Apparatus is also provided for maintaining the golf bag assembly in the support position even upon the application of sidewise forces to the assembly when in the support position.

12 Claims, 11 Drawing Sheets

SUPPORT DEVICE FOR A GOLF BAG

This is a continuation-in-part-of Ser. No. 09/798,630, filed Mar. 1, 2001.

BACKGROUND OF THE INVENTION

1. Field of the Invention

This invention relates to support devices for golf bags, and in particular to devices for controlling the movement of supporting legs attached to a golf bag. The invention further relates to a golf bag stiffening ring assembly for holding supporting legs, a transmission assembly for moving the supporting legs, and an operating device for actuating and operating the transmission assembly. The invention relates both to springs for moving supporting legs which are both inside and outside of the golf bag.

2. Description of the Prior Art

Supporting legs pivotally attached to golf bags and movable between a transport position in which the legs are parallel to the longitudinal axis of the golf bag and a supporting position in which the legs are transverse to the longitudinal axis and contact the ground to cooperate with the bag to support the bag in an upright position, are known in the art. A support device is known from U.S. Pat. No. 5,605,310, wherein the supporting legs of a golf bag can be pivoted via an operating device from a position supporting the golf bag into a position lying against the golf bag. In this connection, the operating device consists of a tongue member coupled onto the golf bag, which is connected via a suitable spring device with the supporting legs. The tongue member can, in this case, be pivoted via a dead center position into two positions, by means of a carrying strap coupled to a clip against the golf bag and, by hand operation, into the position in which the supporting legs, with the aid of the spring member, are brought into the support position. A problem with the foregoing device is that it is not always desirable that these two positions of the tongue member are the only ones possible, but rather that there is also a possible position in which the tongue member is prevented from automatically being pivoted into the other position, past the dead center position, when the carrying strap is pulled.

Another problem with the prior art as shown in the foregoing U.S. patent is that the transmission system for transferring movement to the supporting legs is entirely or partly on the outside of the bag resulting in increasing the outside dimensions of the golf bag, and any portion inside the bag may take up excessive space which decreases the amount of storage space for the golf clubs, which could in turn require that the bag be enlarged to store the golf clubs.

Presently, golf bag manufacturers are required to produce the entire bag, which includes the stiffening ring at the top of the bag. Thus, to make a golf bag having supporting legs, the manufacturer must use as components the ring, the supporting legs, the transmission assembly, the handle and operating device for the legs, and the storage compartment forming device for defining the golf club storage spaces. The manufacturer must make and assemble each of these parts. What is needed, and what the present invention in one of its embodiments provides, is a ring assembly which incorporates the foregoing components which could be made by one manufacturer for sale to other golf bag manufacturers for incorporation into their units.

SUMMARY OF THE INVENTION

It is an object of the present invention to provide a golf bag with supporting legs movable between a transport position and a support position, wherein an operating device is included which can easily convert the control for the movement between an automatic operation for controlling the movement according to the position of the carrying strap and manual operation where the user can releasably lock the supporting legs in the support position.

Another object of the invention is to provide an operating device for the supporting legs of a golf bag having a manually movable member which is pivotally mounted for movement between two positions to automatically move the supporting legs between a support position and a transport position, and a third position past a dead center position to disable an automatic control of the movement of the supporting legs and releasably lock the legs in the transport position.

A still further object of the invention is to provide a compact transmission device for transmitting movement to the supporting legs of a golf bag to move the supporting legs between a support position and a transport position.

An additional object of the invention is the provisions of a transmission device for the supporting legs of a golf bag which does not increase the outside dimensions of the golf bag.

It is still a further addition of the invention to provide a transmission device for the supporting legs of a golf bag which extends across the golf bag and contributes to the functioning of the golf bag.

Yet an additional object is the provision of a transmission device for moving the supporting legs for a golf bag which extends across the golf bag and defines the storage spaces for golf clubs in the golf bag.

Another object is to provide a stiffening ring assembly for a golf bag comprising the supporting legs, the transmission device for the supporting legs, the operating device for the transmission device and the supporting legs, and the control mechanism for operating device, which ring assembly can be constructed separately from the remaining portions of the golf bag and be included as a component for golf bags.

These and other objects will be apparent from the description to follow and from the appended claims.

DESCRIPTION OF THE PREFERRED EMBODIMENTS

Figure 1:
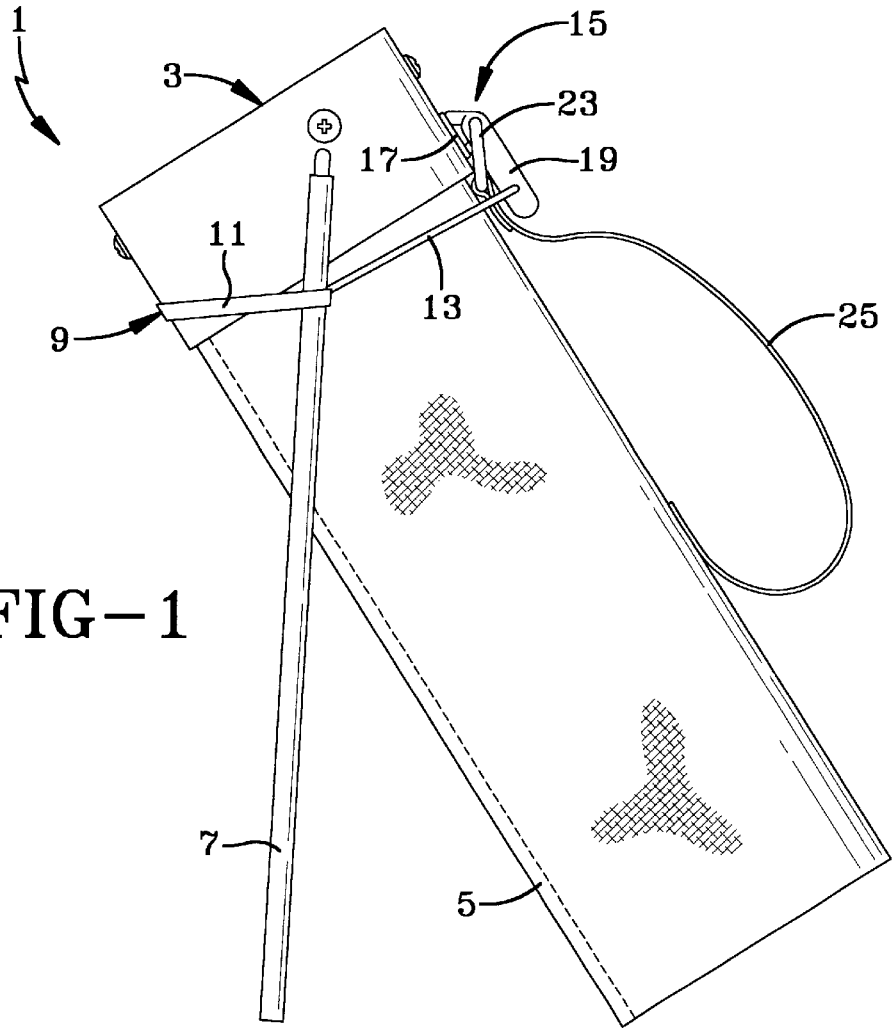
FIG. 1 is a side view of a golf bag assembly incorporating an embodiment of the invention, showing the supporting legs in the support position.

Referring to FIG. 1, schematically illustrated golf bag assembly 1 is shown. Golf bag assembly 1 has a stiffening ring assembly 3 at the upper portion thereof, to which is attached a textile or other fabric-like bag body 5 (which could have varying degrees of stiffness). Golf bag assembly 1 further has supporting legs 7 shown in their supporting or transport position, in which they cooperate with the base of the bag body to support golf bag assembly 1 in an upright position as shown in FIG. 1. Supporting legs 7 are pivotally attached to the golf bag by a suitable assembly, shown in FIG. 1 by the numeral 9. Assembly 9 includes a spring member 11, which could be an elastomeric member such the heavy rubber band as shown which biases the supporting legs to their support position, or possibly a coil spring or the like. A pull rope or cable 13 is attached as shown to supporting legs 7 for acting against the bias of spring member 11 for drawing supporting legs 7 to their transport position against golf bag assembly 1. Spring member 11 can have different forms, and does not have to run on the outside of golf bag assembly 1, and does not have to be at the same height as stiffening ring 2. As explained below, spring member 11 and cable 13 could extend transversely through the golf bag.

Figure 3:
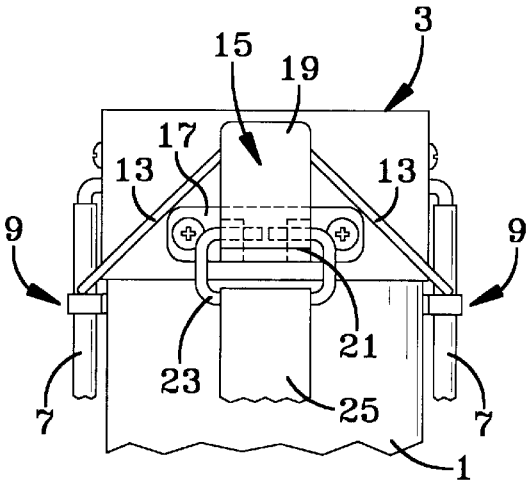
FIG. 3 is a partial side view of the golf bag assembly illustrated in FIG. 1, rotated 90° from the view shown in FIG. 2.
Figure 4:
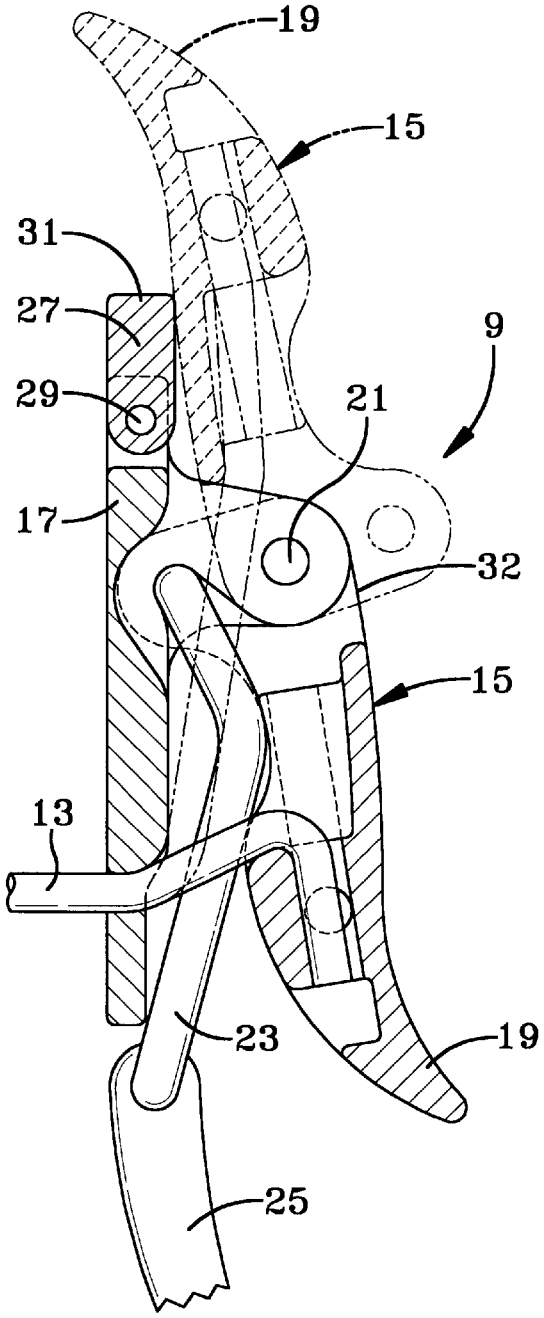
FIG. 4 is a side view of the operating or tongue assembly incorporated in the first embodiment of the invention with the stop member in the inactive position.
Figure 5:
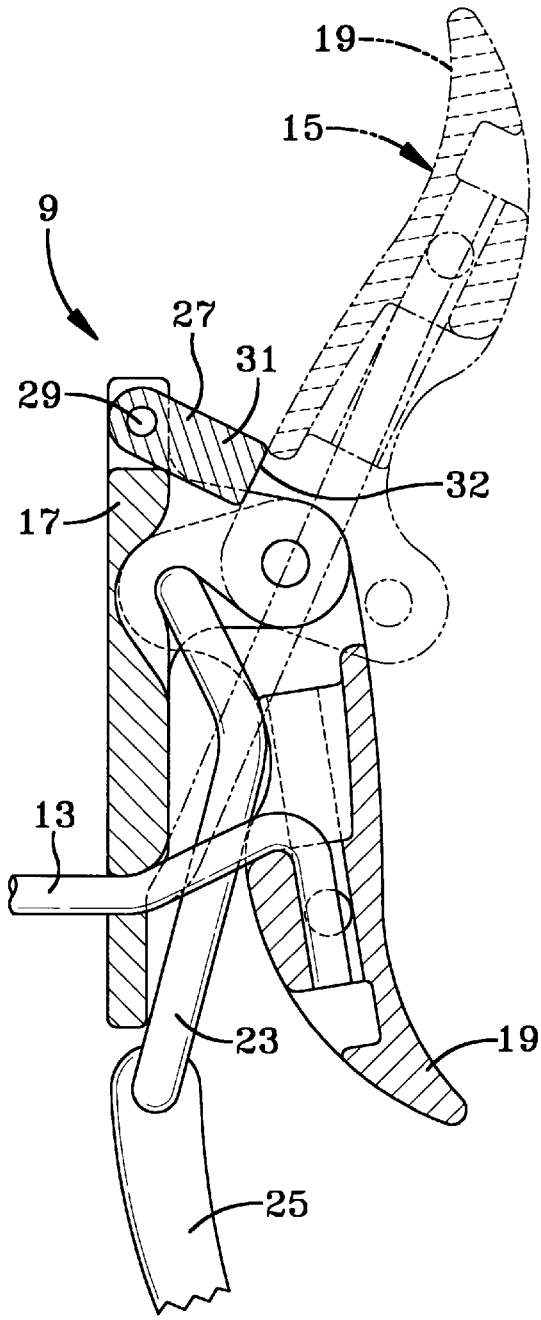
FIG. 5 is a side view of the operating or tongue assembly incorporated in the first embodiment of the invention with the stop member in the active position.

An operating assembly or tongue assembly 15 is attached to golf bag 1 through appropriate fittings and/or a base plate 17 which is fixed to stiffening ring 3. Base plate 17 could be attached to stiffening ring 3 rather than being an integral part thereof, which could make retrofitting and/or replacing of base plate 17 easier. Tongue assembly 15 is composed of a hand lever 19, which is pivotally connected to base plate 17 by means of an axle 21 (FIGS. 3, 4 and 5). Cable 13 is attached to hand lever 19 such as by an appropriate cable clamp, so that cable 13 moves with the movement of hand lever 19 or vice versa. A clip 23 is attached to hand lever 19, and a carrying strap 25 for golf bag 1 is coupled to golf bag 1 by reason of its attachment to clip 23. Clip 23 moves in response to the movement of hand lever 19, and hand lever 19 moves in response to the movement of clip 23 and to the movement of carrying strap 25 when golf bag 1 is being carried or when bag 1 is released. When golf bag 1 is picked up, strap 25 applies tension to clip 23, and clip 23 presses against the lower side of lever 19 to move hand lever 19 from its downward position shown in FIG. 1 wherein supporting legs 7 are in the support position, to the position shown in FIG. 3 wherein supporting legs 7 are in the transport position in response to the movement of hand lever 19 to the upper position.

The operative attachment location of spring member 11 to supporting legs 7 and the coupling of spring member 11 to tongue assembly 15 is such that when hand lever 19 passes the dead center of the spring biased tongue assembly 15, hand lever 19 snaps to either to the uppermost position in which supporting legs 7 are in the transport position against golf bag 1, or to the lowermost position in which supporting legs 7 are in the support position. When golf bag 5 is picked up by carrying strap 25, hand lever 19 is moved upwardly past the dead center position by clip 23 to the position shown in FIG. 2, and spring member 23 pulls supporting legs 7 into the transport position. When the golfer moves hand lever 19 past the dead center position, spring member 11 pulls lever 19 to the down position and moves supporting legs 7 to the support position through the connection between spring member 11 and legs 7.

Figure 11:
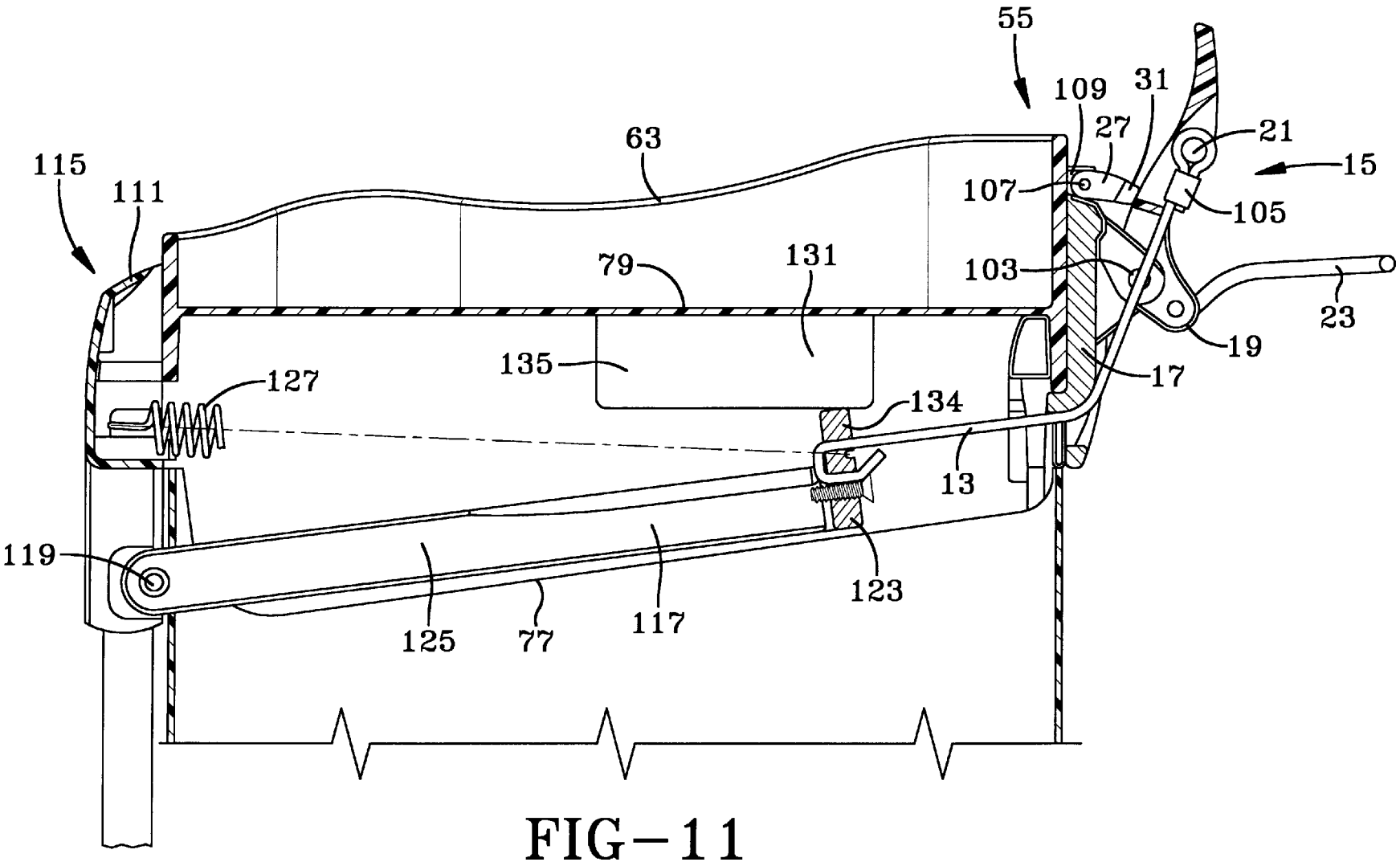

It is sometimes desired by users of golf bags with supporting legs that the supporting legs assume the support position from the transport or contact position whenever the user is not carrying the golf bag, i.e. the supporting legs automatically assume the support position whenever no force from carrying bag 5 is put on hand lever 19 of tongue assembly 15 such as when there is no upward force placed on carrying strap and on clip 23. That is, no manual force should be required to move hand lever 19 from the upper position to the lower position. In order to accomplish this objective, a stop member 27 is pivotally attached to golf bag assembly 1 by means of an axle 29 supported by base plate 17 of the tongue assembly 15 as shown in FIGS. 4 and 5. Stop member 27 can be manually moved from its inactive position shown in FIG. 4 to its active or stop position shown in FIG. 5. Stop member 27 includes a lever 31. When lever 31 is in its inactive position, it does not effect the movement of hand lever 19 to its uppermost position as is evident from FIG. 4. However, when lever 31 is in its stop position illustrated in FIG. 5, hand lever 19 cannot reach its dead center point since its abutment surface 32 contacts lever 31 as it approaches its upper position but before it reaches its dead center point. The advantage is that if lever 31 is in its stop position as shown in FIG. 11, the bag assembly automatically goes to its support position when the pressure on the strap 57 or on lever 31 is released.

Figure 2:
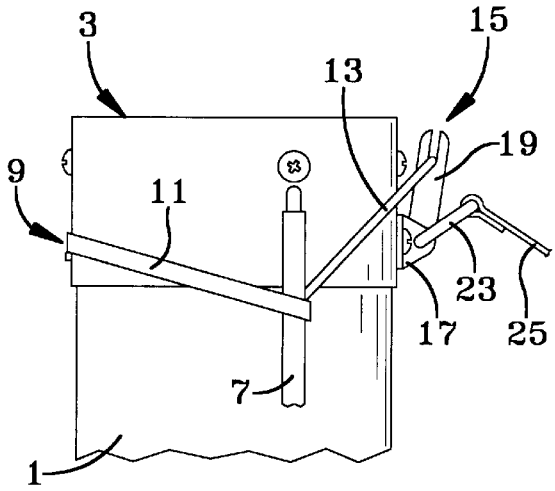
FIG. 2 is a partial side view of the golf bag assembly illustrated in FIG. 1, showing the supporting legs in the transport position.

Referring to FIGS. 4 and 5, hand lever 19 is shown in solid lines in its position also shown in FIG. 1 in which supporting legs 7 are in their support position, and in dashed lines in FIG. 5 when lever 19 is in near the position shown in FIG. 2 but prevented from passing its dead center position—wherefore upon the release of the force required to hold lever 19 against lever 31, spring member 11 moves hand lever 19 downward and supporting legs 7 to the support position.

Stop member 27 can have other configurations than that shown in FIGS. 4 and 5. For example, it could effect its function by engaging clip 23 to prevent tongue assembly 15 from passing the dead center position for moving supporting legs 7 to the transport position.

Figure 6:
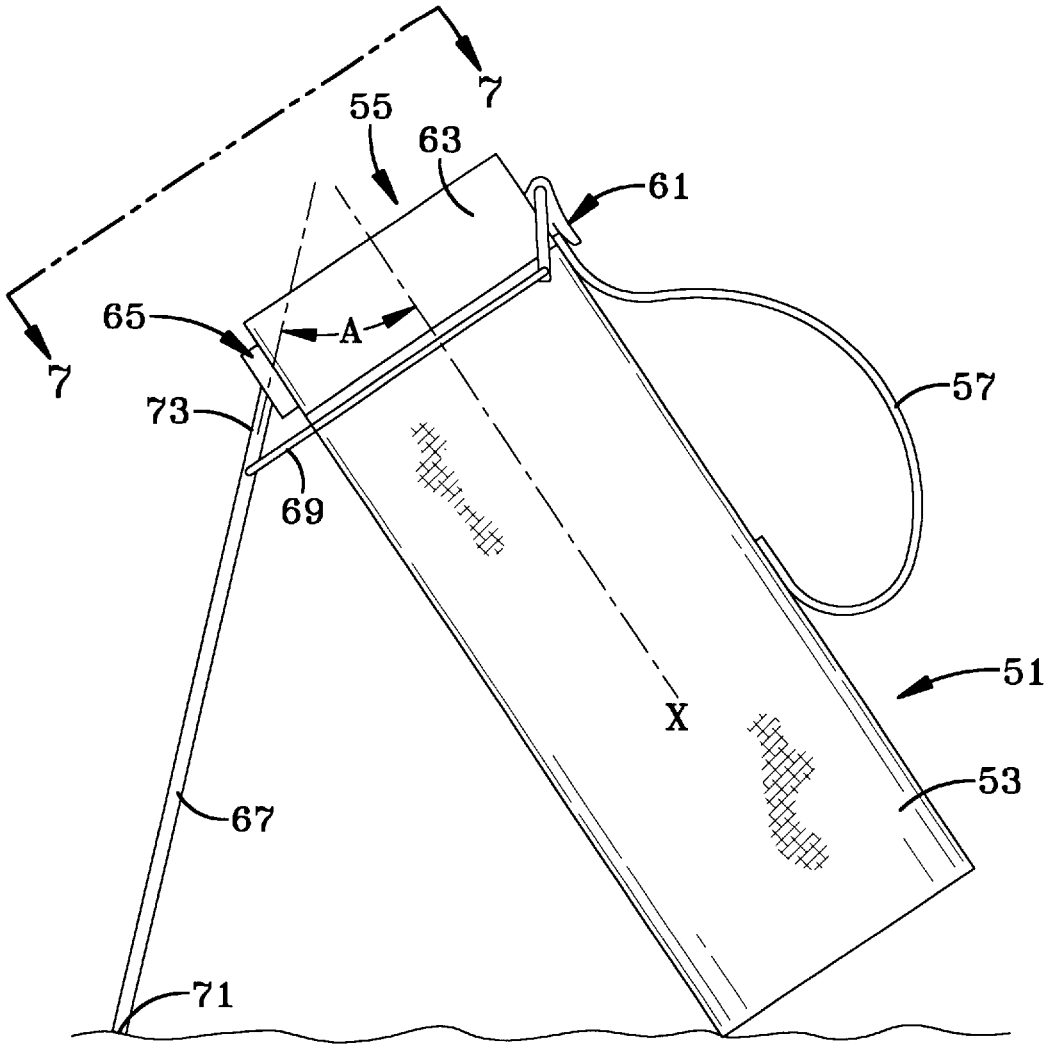
FIG. 6 is a side view of a golf bag incorporating a second embodiment of the invention, showing the supporting legs in the support position.

Referring next two the second embodiment of the invention, FIG. 6 illustrates a golf bag assembly 51 having a golf bag 53 similar to that discussed with respect to the first embodiment, and a stiffening ring assembly 55. A carrying strap 57 is attached to bag 53 by an appropriate clip at the strap's lower end and to a clip 59 (FIG. 7) forming part of an unlatching, operating or tongue assembly 61 at the upper end of strap 57. Stiffening ring assembly 55 has a stiffening ring 63 preferably made from hard, rigid plastic, to which is attached a bearing plate assembly 65 from which extend a pair of supporting legs 67 which are movable between a support position shown in FIGS. 6 and 7, and a transport position in which legs 67 are adjacent to bag 53 and parallel to each other, which is effected when strap 57 is pulled away form bag 53 when bag 53 is picked up and operates a control device or transmission system 69 to move legs 67 towards and against bag 53. Legs 67 have lower ends 71 for engaging the ground when legs 67 are in the supporting position, and upper ends 73 which are constructed to move legs 67 to assume the supporting position or the transport position according the state of control device 69. The construction and operation of control device 69 and of the upper ends 73 of legs 67 can advantageously be those described in U.S. patent application Ser. No. 09/798,630 filed on Mar. 1, 2001. Golf bag 53 has a longitudinal axis x as shown. Supporting legs 67 make an angle A with longitudinal axis x when legs 67 are in the supporting position.

Figure 7:
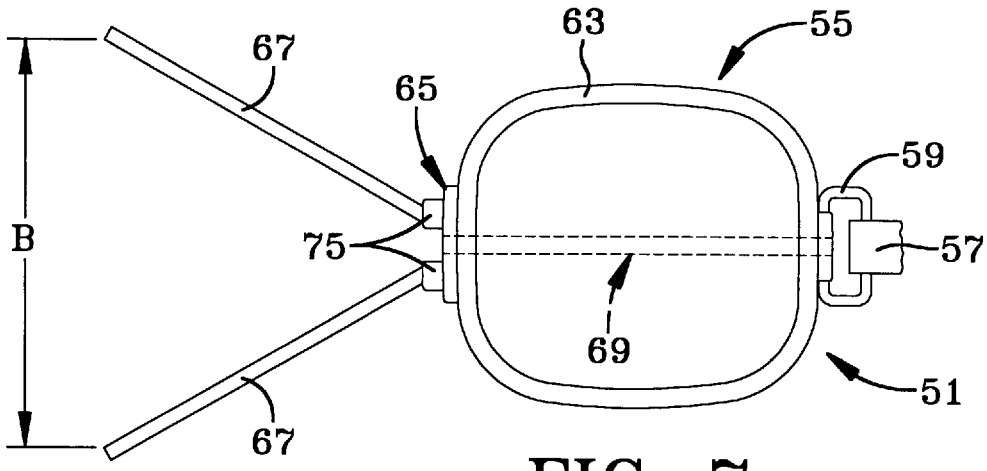
FIG. 7 is a view taken in the direction of the arrows 7—7 in FIG. 6, illustrating a stiffening ring assembly disclosing a transmission system in schematic form.

FIG. 7 is another view of the golf bag assembly 51 shown in FIG. 6. The lower ends of supporting legs 67 are separated by the distance B when in the support position, which is a sufficient distance to assure balance under playing conditions. Supporting legs 67 are rotatably journaled via spatial axes 75 in bearing plate 65, as described in detail in the above-mentioned U.S. patent application Ser. No. 09/798,630. Control device or transmission system 69 is shown in schematic form, and can be seen as extending transversely across and through golf bag 53 so as not to widen bag 53 and not require parts which would require sufficient length to operate around the periphery of bag 53 and would be required to withstand the force and torque which would be imparted to the working components of the transmission systems if it were to be located around the periphery of the bag.

Stiffening ring assembly 55 is shown in FIGS. 8–12 Assembly 55 includes stiffening ring 63, a transmission housing 77 which extends out of the plane of the figure to form an apex 79. Two walls 81,83 extend across stiffening ring 63, and are connected to bore housings 85 and to connection 87 which extend inwardly from ring 63. Walls 81,83 are connected to housing 77 and apex 79. Ring 63 cooperates with walls 81,83 and housing 77 to define six chambers 89–94 for holding golf clubs. Stiffening ring assembly is preferably an integral unit composed of stiffening ring 63, housing 77, apex 79, walls 81,83, housings 85,connections 87 and a pair of support walls 95,97 discussed below.

Operating or tongue assembly 15, described with respect to the first embodiment of the invention shown in FIGS. 1–5 can be used in the golf bag assembly 55. Thus, base plate 17 is attached to support wall 97 by screws 99. Base plate 17 is shown having parallel arms 101 holding an axle 103 for hand lever 19. Clip 23 is pivotally mounted on an axle parallel to axle 103 but located closer to ring 63. Pull member or cable 13 extends between the arms of clip 23, and is connected to axle 21 by means of a cable clamp 105. Axle 21 is located in hand lever 19. Stop member 27 which includes lever 31 is pivotally mounted on axle 107 extending between two walls 109 of base plate 17.

A second base plate 111, on the opposite side of the golf bag from plate 17, is attached to wall 95 by means of screws 113. A pair of pivoting parts 115 for holding the upper portions of a pair of supporting legs extends transversely outwardly, since the unit is in the support position. Pivoting parts 115 are attached to a yoke 117 which is described below, by means of a screw and washer assembly 119 into holes in flanges 121 extending from pivoting parts 115, and in holes in yoke 117. The operation of the movement of pivoting parts 115 is described in U.S. patent application Ser. No. 09/798,630 mentioned above.

Figure 8:
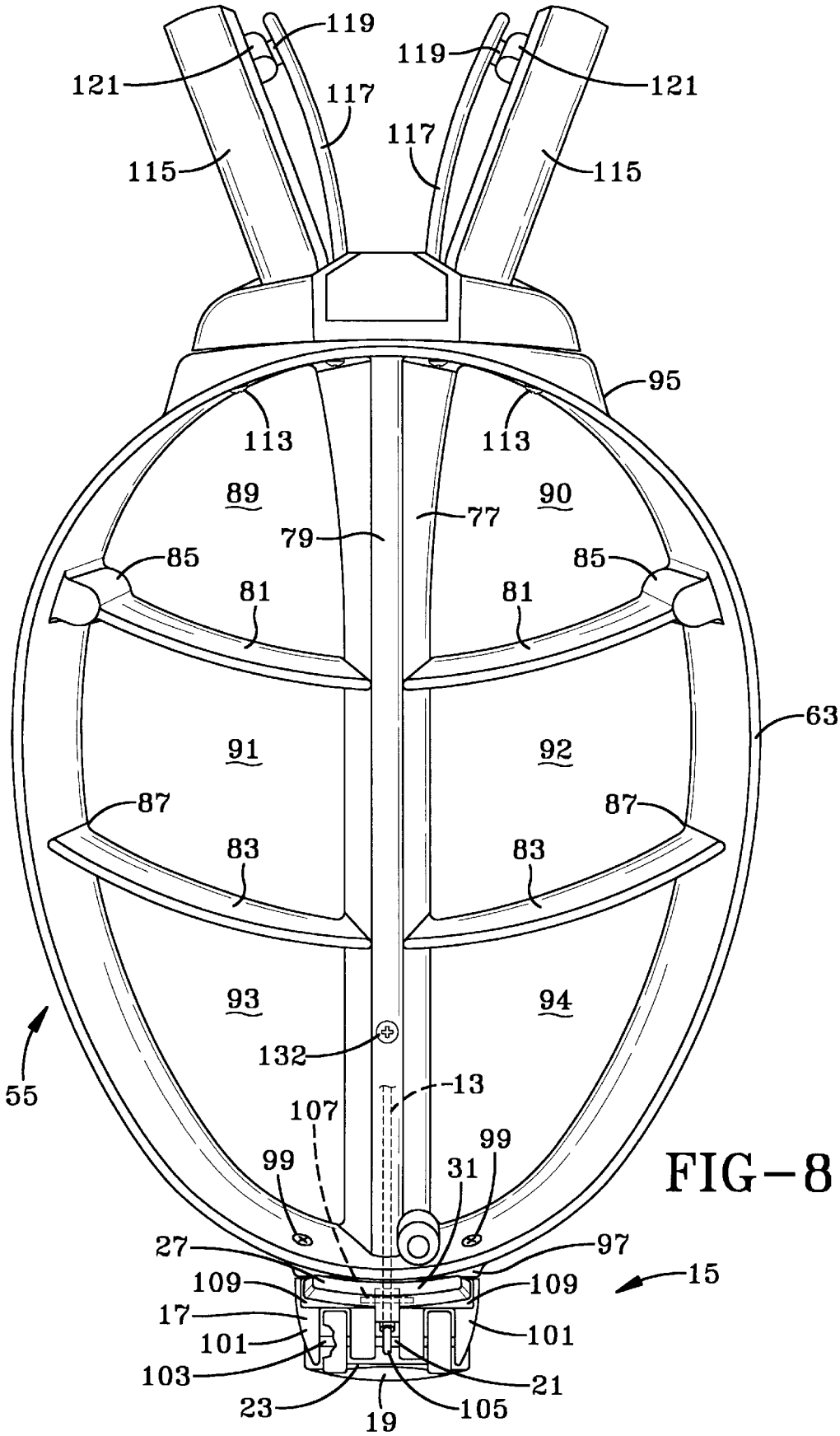
FIG. 8 is a top view of the stiffening ring assembly shown in FIG. 7, incorporating the transmission system.
Figure 9:
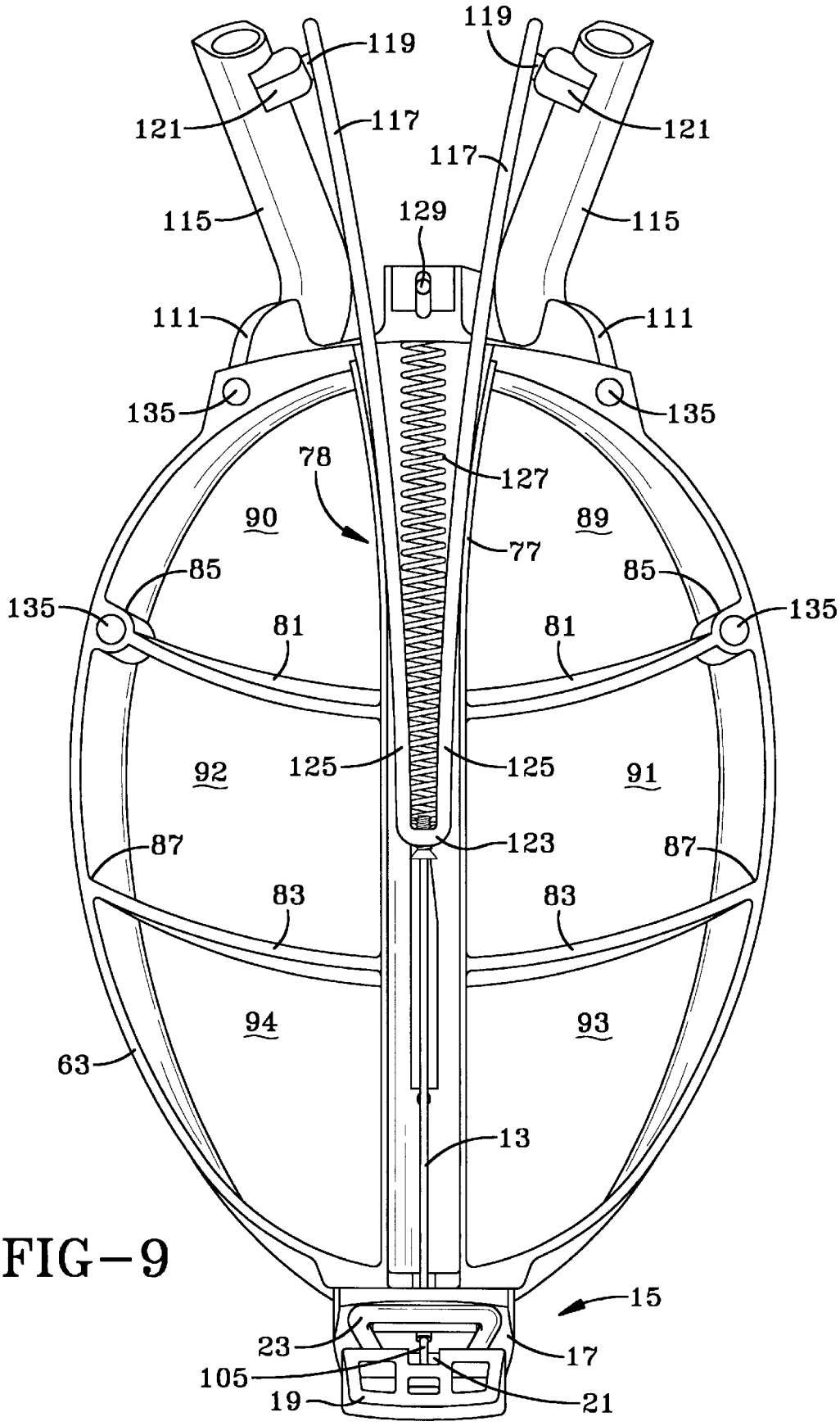
FIG. 9 is a partially cutaway bottom view of the stiffening ring assembly shown in FIG. 8, showing the components of the transmission assembly.
Figure 12:
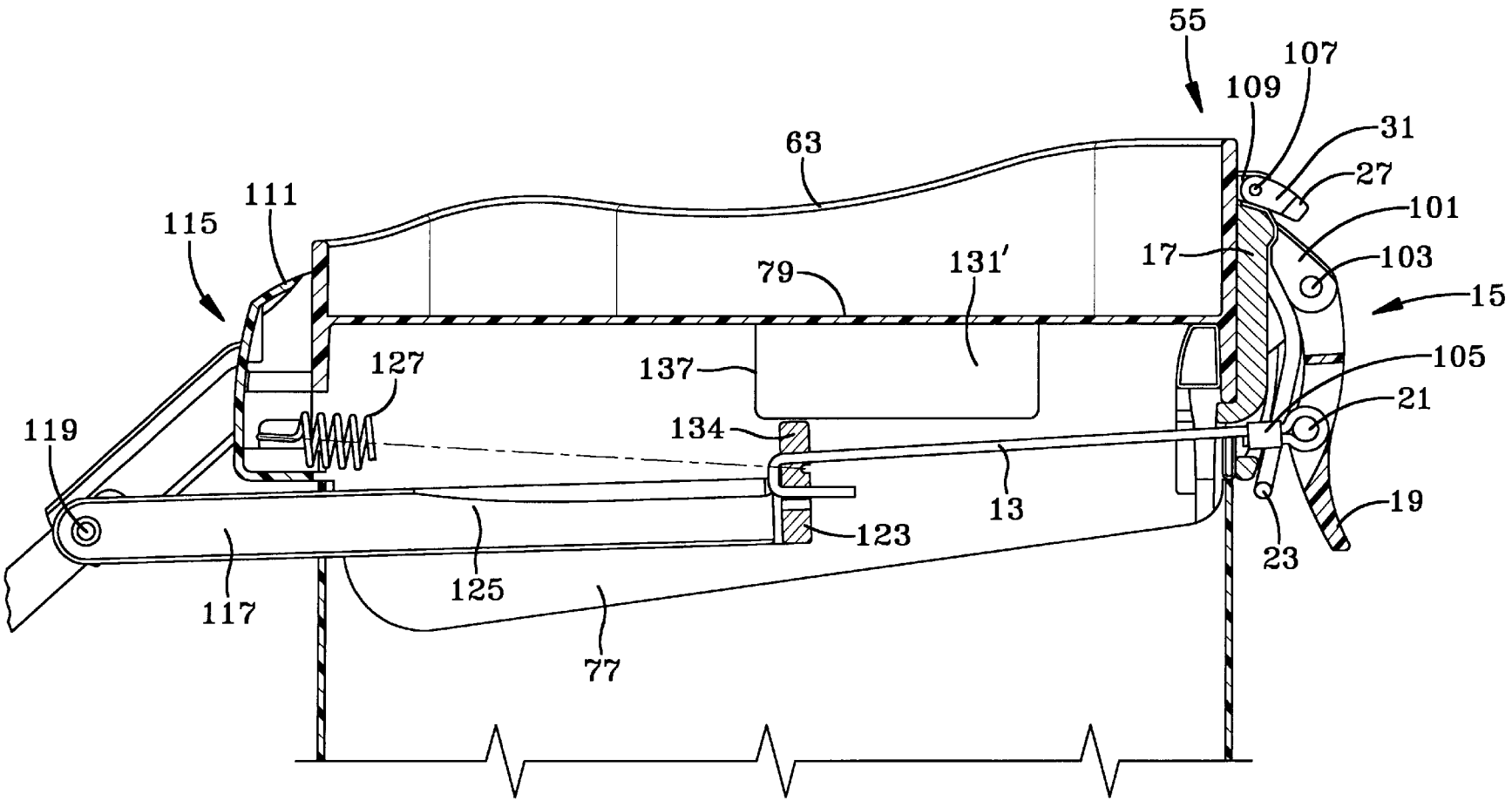
FIG. 12 is a cross sectional view similar to FIG. 10, but with a modified guide assembly.

The underside of stiffening ring assembly 55 is shown in FIG. 9. Many of the parts described with respect to FIG. 8 are also shown in FIG. 9. Disposed within housing 77 is cable or pull member 13 which is connected to axle 21, and is connected to a juncture 123 of a pair of yoke arms 125 of yoke 117. A coil spring 127 is also connected to juncture 123, and to support wall 111 by means of a pin 129 which extends through a loop in the end of spring 127 into an appropriate pin receiving hole in wall 111. Yoke 117 is a hard but flexible member in which arms 125 are biased away from each other because of their attachment to pivoting parts 115 under the influence of spring 127, which urge parts 115 to the support position. Coil spring 127 biases yoke 117 and cable 13 towards wall 111 and pin 129. These parts are also shown in FIGS. 10–12.

The apparatus shown in FIG. 9 is in the supporting position. Hand lever 19 is positioned against bag 63 against which is it pushes clip 23 by virtue of spring 127 urging yoke 117 and cable 13 towards wall 111 and pin 129. The free ends of yoke arms 125 are urged apart from a normally inwardly biased position, by pivoting parts 115 under the bias of spring 127. When hand lever 19 is pivoted towards the up position, it pulls cable 13, yoke 117, spring 127 and pivot parts 115 towards lever 19. Assuming stop member 27 is in its inactive position, hand lever 19 passes the dead center position, and rests against stiffening ring 63. Yoke 17 is withdrawn into housing 77 and pivot parts 115 are held against golf bag 51. When hand lever 19 is moved downward past the dead center position, spring 127 effects the return of the parts to their positions in accordance with the support position.

In order to assure a smooth movement of yoke 117 and the parts to which it is connected in housing 77, a guide assembly 78 is provided. A guide rail 131 is attached to the underside of apex 79 such as by means of a screw 133 (FIG. 10), and a guide member 134 is located on top of juncture 123 for riding along the surface of guide rail 131 to assure uniform movement and prevent yoke 117 from wobbling during its movement. Guide rail 131 is preferably tapered as shown at numeral 135 for smooth movement of member 133 from the support position to the transport position and vice versa. Of course this is not necessary as shown in FIG. 12, where the corresponding surface is shown at numeral 137, forming an end part of guide rail 131'.

Figure 10:
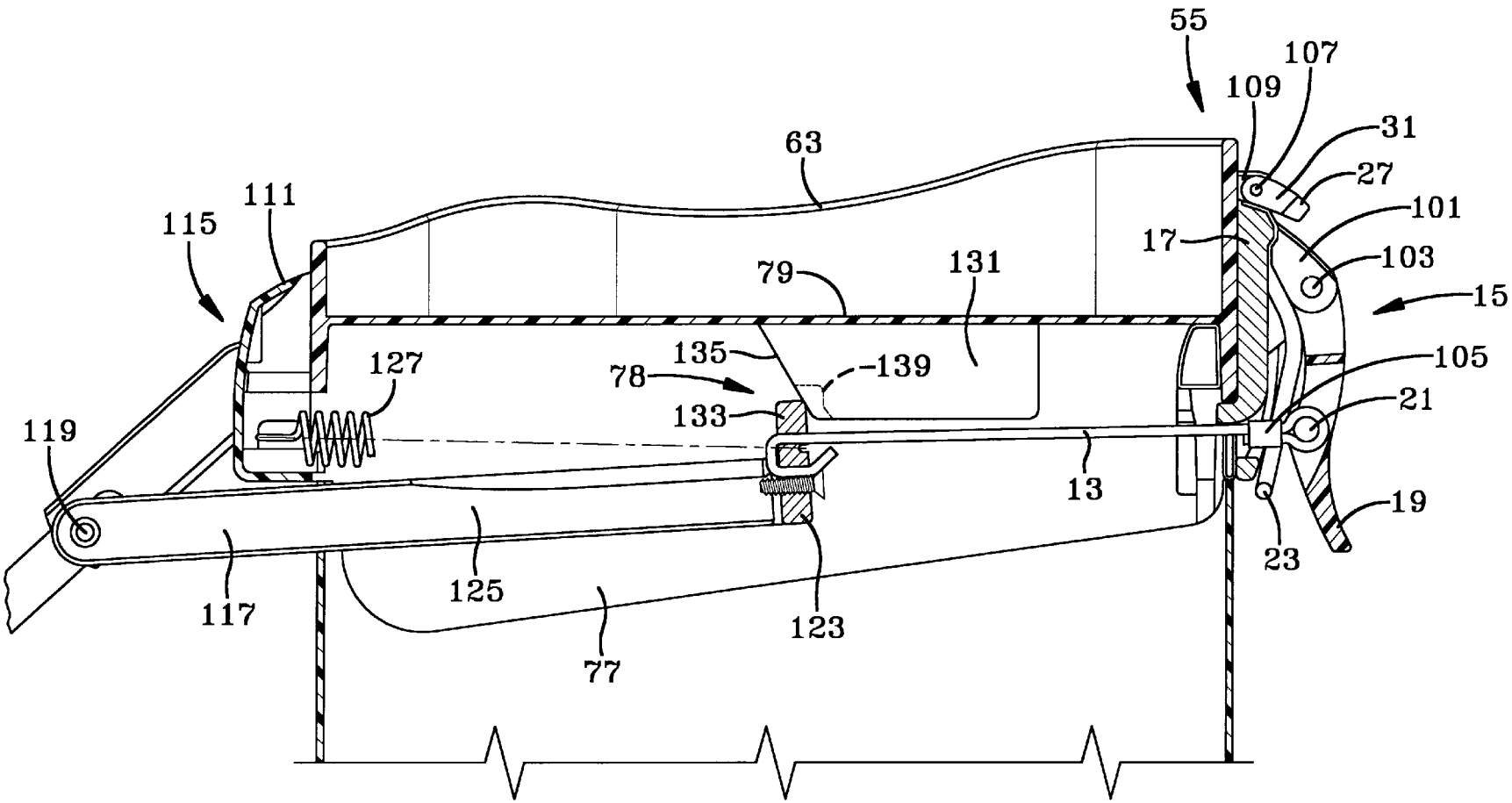
FIGS. 10 and 11 are cross sectional views of the stiffening ring assembly and of the upper portion of the golf bag assembly in the support condition and in the transport condition, respectively.

There are particular advantages to the guide rail 131 and its associated parts as shown in FIG. 10. If the unit is in the support position, and force such as wind force is applied against the side of the bag have force components parallel to the axis of spring 27, this force is applied by guide member 133 directly against taper 135, which prevents member 33 and legs 67 from moving from the support position to the transport position, to assist in helping the golf bag to remain in its upright position. Taper 135 could be eliminated or modified by one or more notches 139 shown in dotted lines in FIG. 10 for receiving and holding member 133 in place and prevent the undesired movement of the supporting legs to their position against the golf bag. Even with this provision, the desired movement of member 33 to a smooth portion 138 of guide rail 131 is accomplished by the pulling of cable 13 by the raising of hand lever 19. The latter action is not impeded by taper 135 or notch(es) 136.

Figure 13:
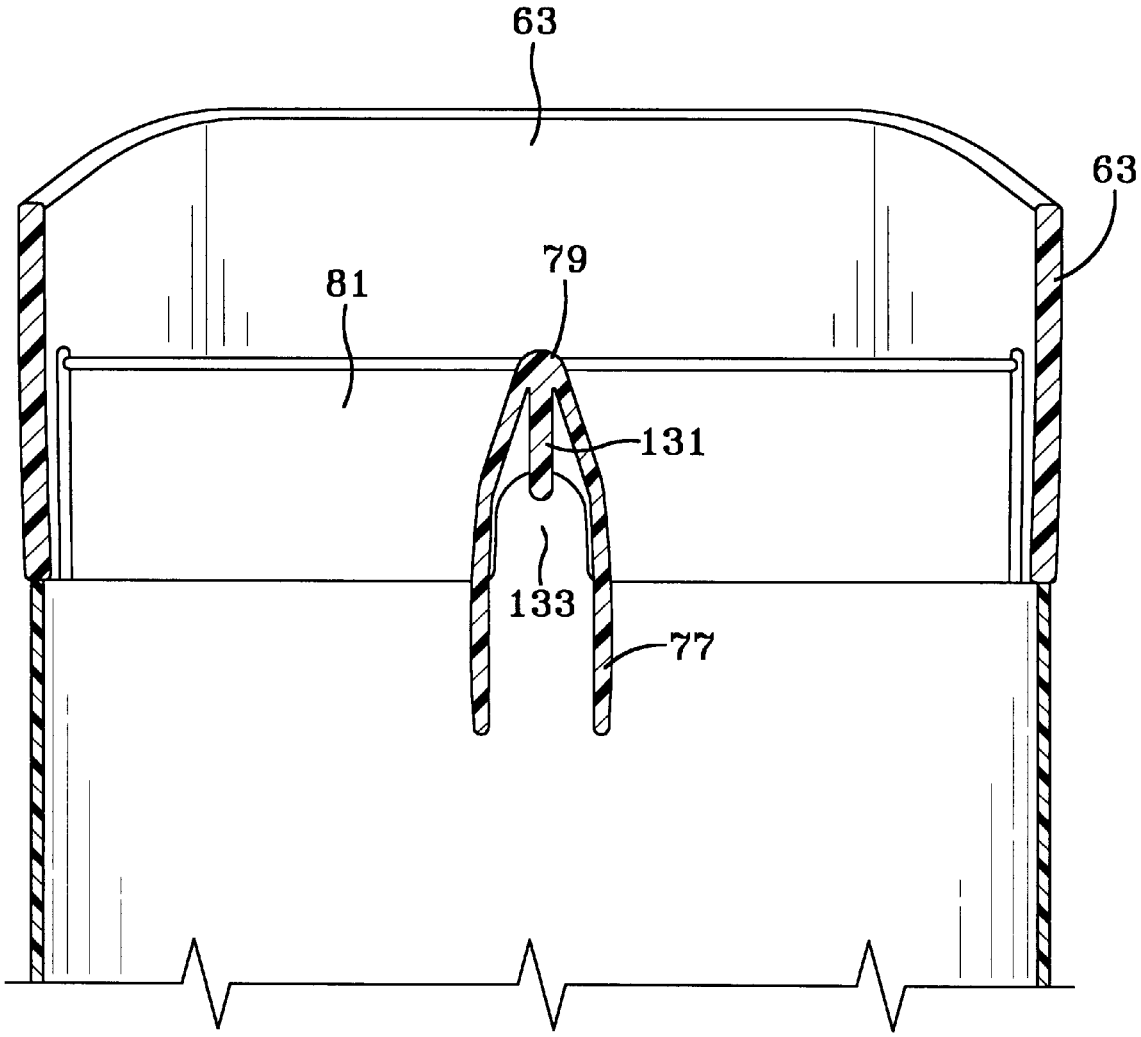
FIG. 13 is a detailed view of a cross-sectional view transmission housing showing the guide assembly.
Figure 16:
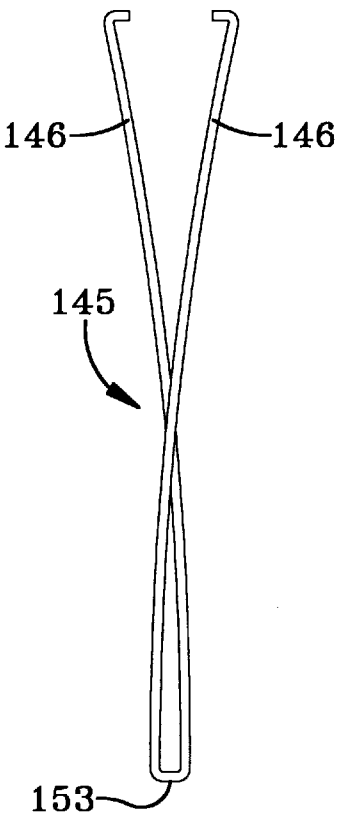
FIG. 16 is a side view of a spring assembly used in the embodiment of the invention shown in FIG. 14.

Guide rail assembly 78 is also shown in FIG. 13. Guide rail 131 extends from apex 79 for engagement by guide member 133. However in this figure, there is no taper or notch(es) as shown in FIG. 10.

Support ring assembly 55, with operating device 15, the supporting leg assembly and transmission system 69, can all be provided as one complete assembly. Therefore, the manufacturer of such a complete assembly can ship it manufacturers of golf bag assemblies, who can assemble it in a fast and easy fashion. In this regard, a series of holes or bores shown generally by the numeral 135 can receive connecting members from the golf bag portion of the final assembly, to provide an efficient and effective product for assembly.

Figure 15:
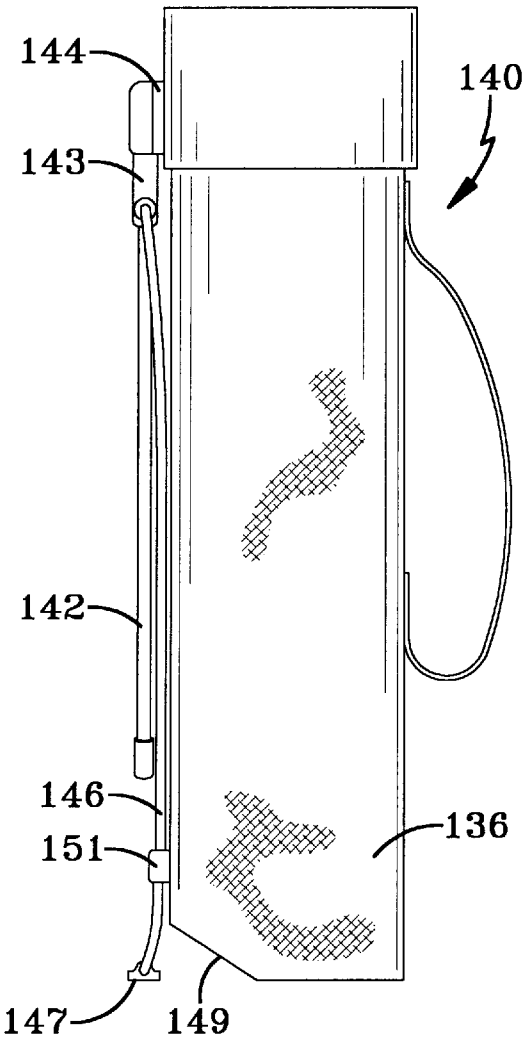
FIG. 15 is another side view of the embodiment of the invention shown in FIG. 14 rotated 90° from that shown in FIG. 14.
Figure 14:
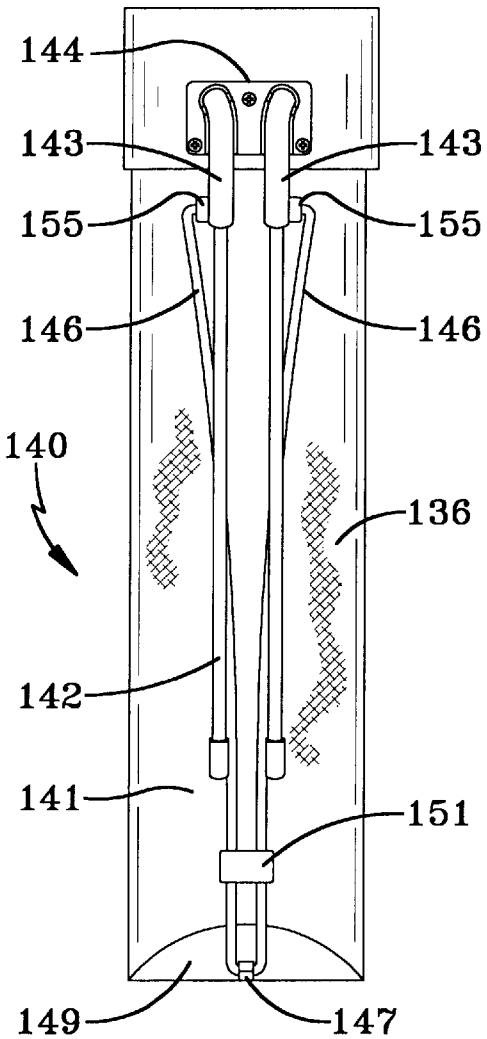
FIG. 14 is a side view of another embodiment of the invention, shown in the transport position.

Another embodiment of the invention is shown in FIGS. 14–18. In this embodiment, a golf bag assembly 140 has a golf bag 141 and a pair of supporting legs 142 which extend from pivoting parts 143 (which could be similar to pivoting parts 65 discussed earlier) extending from a base plate 144. A bent wire spring 145 has inwardly biased arms 146 which extend from a base member 147 near a base 149 of golf bag assembly 140 through a bore 150 in a guide member 151. Springs 146 are connected to each other through a support base 153 and to legs 142 at spring connecting members 155. Arms 146 bias supporting legs 142 to their transport or closed position as shown in FIGS. 14 and 15.

Figure 18:
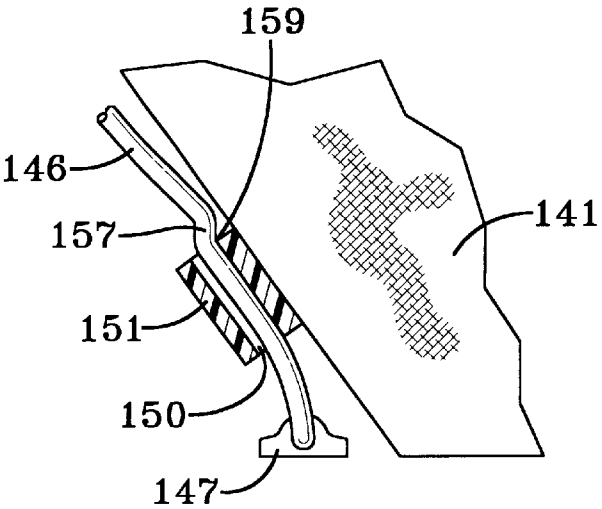
FIG. 18 is an enlarged view of the spring guide and spring employed in the embodiment of FIG. 14.
Figure 17:
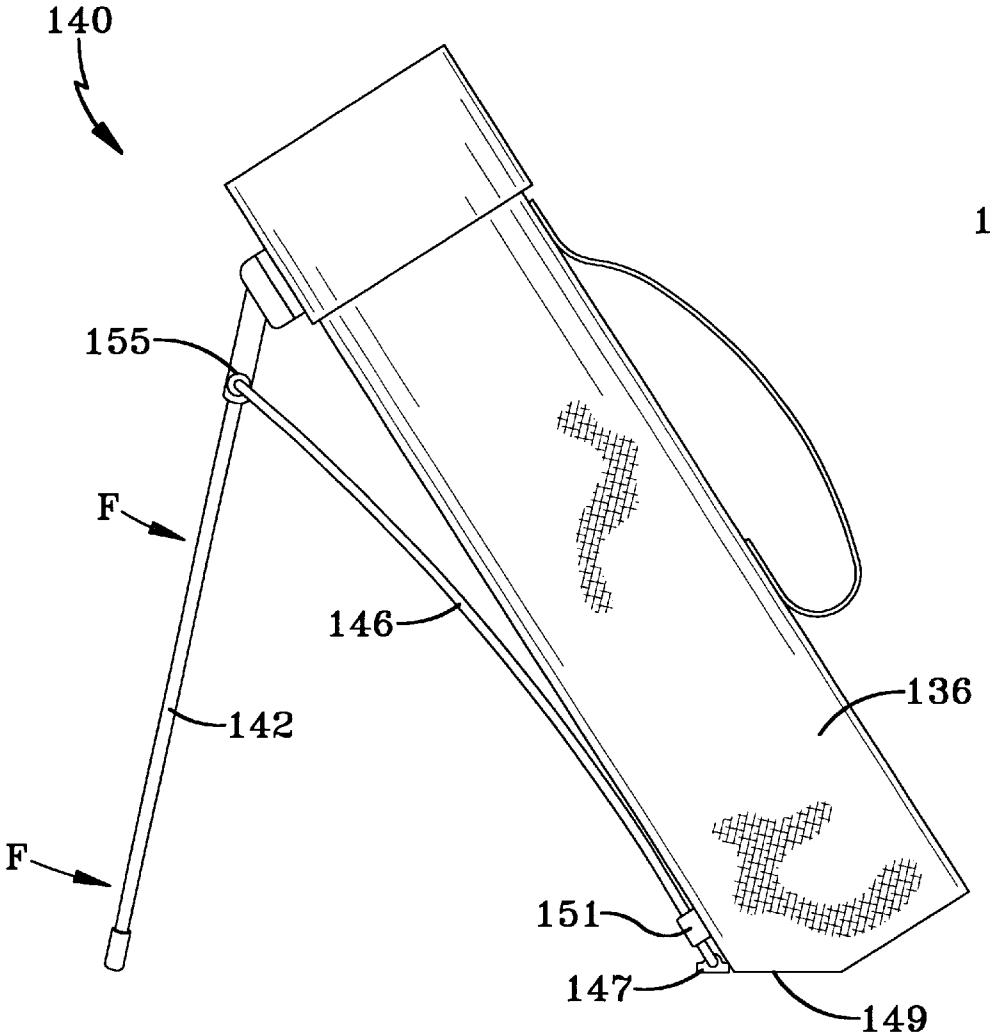
FIG. 17 is a side view of the embodiment shown in FIG. 14, but in the support position.

Spring arms 145 are bent to form a bent portion 157. In order to put golf bag assembly 140 in the support position as shown in FIG. 17, the golfer tips assembly 140 onto base 149, and the weight of the bag and its contents overcomes the bias of spring arms 146 and urges legs 142 away from the transport position and into the support position. Bent portions 157 of arms 146 help keep assembly 140 in an upright position even upon the exertion of side force as shown by arrows F, which could for example be wind forces, by being engaged by notches 159 in guide member 151 as shown in FIG. 18. In order to return legs 142 into their closed or transport position, the golfer merely tips golf bag 141 towards a vertical position so that the full weight of golf bag assembly 140 is not pressing on spring arms 146, and spring arms 146 return supporting legs to their position shown in FIGS. 14 and 15.

The invention has been described in its preferred forms, but variations and modifications within the spirit and scope of the invention may occur to those skilled in the art from the preceding description and in the appended claims.

What is claimed is:

1. Apparatus for controlling operation supporting legs for a golf bag assembly having a longitudinal axis, the supporting legs being pivotally mounted to at least one side of a golf bag and having attaching portions attachable to the golf bag and end portions for engaging the ground to cooperate with the golf bag to support the bag in an upright position, the supporting legs having a support position transverse to the longitudinal axis for supporting the golf bag assembly in the upright position and a transport position parallel to the longitudinal axis, said apparatus comprising:

supporting leg holding members for holding upper portions of said supporting legs movable between a golf bag support position and a transport position disposed against the golf bag;

a supporting legs pivot assembly for pivoting the supporting leg holding members between the support position and the transport position;

a supporting leg operating assembly for moving the supporting leg holding members between the support position and the transport position, and for controlling the functioning of said supporting leg operating assembly, said supporting leg operating assembly including a transmission system extending across and through the golf bag, a connecting assembly for connecting said transmission system to the supporting legs pivot assembly, and an operating member operatively connected to said transmission system and located on the opposite side of said golf bag from said pivot assembly, said transmission system being operatively connected to said pivot assembly and to said operating member and including a housing, said housing forming part of chambers for holding golf clubs in the golf bag; and a movable spring biased pull member assembly operatively connected to the supporting legs, said pull member assembly extending transversely to the longitudinal axis and biasing the supporting legs to the support position;

said operating member being attached to said pull member assembly and being pivotally mounted on the golf bag assembly on a pivot axis transverse to the longitudinal axis and to said pull member assembly, said operating member being rotatable between a rest position wherein said pull member assembly holds said supporting legs in the support position and a closed position wherein said operating member releasably locks the supporting legs in the transport position, said operating member assuming the closed position in response to application of a predetermined holding force to said operating member and assuming the rest position in response to withdrawal of the holding force from said operating member.

2. Apparatus for controlling operation of supporting legs for a golf bag assembly having a longitudinal axis, the supporting legs being pivotally mounted to a golf bag and having attaching portions attachable to the golf bag and end portions for engaging the ground to cooperate with the golf bag to support the bag in an upright position, the supporting legs having a support position transverse to the longitudinal axis for supporting the golf bag assembly in the upright position and a transport position parallel to the longitudinal axis, said apparatus comprising:

a movable spring biased pull member assembly operatively connected to the supporting legs, said pull member assembly extending transversely to the longitudinal axis and biasing the supporting legs to the support position; and an operating member attached to said pull member assembly and being pivotally mounted on the golf bag assembly on a pivot axis transverse to the longitudinal axis and to said pull member assembly:

said operating member being rotatable between a rest position wherein said pull member assembly holds said supporting legs is the support position and a closed position wherein said operating member releasably locks the supporting legs in the transport position;

said operating member assuming the closed position in response to application of a predetermined holding force to said operating member and assuming the rest position in response to withdrawal of the holding force from said operating member; and said operating member being further movable to a releasable position for releasably holding said supporting legs in the transport position provided a predetermined holding force is applied to said operating member; and wherein said apparatus further comprises a stop member movable between an active position for preventing said operating member from assuming said closed position and an inactive position for enabling said operating member to assume said closed position.

3. Apparatus according to claim 2 wherein said spring biased pull member assembly and said attached operating member have a dead center position, wherein said pull member assembly urges said operating member to the rest position when said operating member is moved from the rest position but not to the dead center position, and wherein said operating member assumes the closed position when said operating member is moved from the rest position and beyond the dead center position.

4. Apparatus according to claim 3 wherein the active position of said stop member prevents said operating member from moving from the rest position beyond the dead center position.

5. Apparatus according to claim 4 wherein said stop member is manually movable between the active position and the inactive position.

6. Apparatus according to claim 1 wherein said operating member includes a hand lever movable between the rest position and the closed position, and a carrying strap clip operatively mounted on the golf bag assembly and movable for operating said hand lever, said clip moving said hand lever to assume the closed position in response to the exertion of force to a carrying strap attached to said clip, and said pull member assembly moving said operating member to the rest position upon the release of force to the carrying strap.

7. Apparatus according to claim 4 wherein said hand lever is pivotable about a first axis transverse to the longitudinal axis, said stop member is pivotable about a second axis parallel to the first axis, and said clip is pivotable about a third axis parallel to said first axis.

8. Apparatus for moving a pair of legs pivotally mounted on one side of a golf bag, the golf bag having a longitudinal axis, from a transport position wherein the pair of legs is located against the bag and aligned parallel to the longitudinal axis, to a support position wherein the legs are transverse to the longitudinal axis, the legs each having a free end for engaging the ground for cooperating with the bag to support the bag in an upright position, said apparatus comprising:

a movable yoke having a pair of arms, each arm being operatively connected to one of the legs, said arms meeting at a juncture and being movable towards each other to rotate the legs towards each other and being movable apart from each other to move the legs to the support position;

a housing extending through and across the golf bag for holding said yoke during movement of said yoke;

a pull member operatively connected to said yoke and extending through said housing structure, said pull member being biased to move said arms of said yoke member apart from each other to pivot the legs to the support position, and to move said arms towards each other to move the legs to the transport position; and an operating device movably mounted on a different side of the golf bag from the pair of legs and connected to the other end of said pull member, said operating device being movable between a closed position for pulling said pull member to urge said arms towards each other to move the legs to the transport position against the bias of said pull member, and an open position for urging said arms of said yoke apart from each other to move the legs to the support position.

9. Apparatus according to claim 8 wherein said pull member comprises a cable connected at one end to said operating device and at the other end to said yoke, and said apparatus further comprises a spring connecting said yoke to the golf bag opposite from said operating device for biasing the legs to the support position.

10. A stiffening ring assembly for a golf bag, said stiffening ring assembly comprising:

a ring shaped member for forming a top of a golf bag assembly, supporting leg holding members for holding the upper portions of supporting legs movable between a golf bag support position and a transport position disposed against the golf bag;

a supporting legs pivot assembly for pivoting the supporting leg holding members between the support position and the transport position, said pivot assembly being located on one side of said ring shaped member; and a supporting leg operating assembly for moving the supporting leg holding members between the support position and the transport position, and for controlling the functioning of said operating assembly;

wherein said supporting legs pivot assembly is located on one side of the golf bag;

wherein said supporting leg operating assembly includes a transmission system extending across and through the golf bag, a connecting assembly for connecting said transmission system to the supporting legs pivot assembly, and an operating member operatively connected to said transmission system and located on an opposite side of said ring member from said pivot assembly, said transmission assembly being operatively connected to said pivot assembly and to said operating member; and wherein said transmission system includes a housing, said housing forming part of the chambers for holding golf clubs in the golf bag.

11. A stiffening ring assembly for a golf bag, said stiffening ring assembly comprising:

a ring shaped member for forming the top of a golf bag assembly, supporting leg holding members for holding the upper portions of supporting legs movable between a golf bag support position and a transport position disposed against the golf bag;

a supporting legs pivot assembly for pivoting the supporting leg holding members between the support position and the transport position, said pivot assembly being located on one side of said ring shaped member; and a supporting leg operating assembly for moving the supporting leg holding members between the support position and the transport position, and for controlling the functioning of said operating assembly; said supporting leg operating assembly comprising:

a transmission assembly, a connection assembly for connecting the transmission assembly to the legs, and an operating member connected to said transmission assembly, said transmission assembly including a housing, an elongated pull member operatively connected to the legs and to said operating member for moving in response to the movement of said operating member to move the legs, a first guide member connected to said housing and a second guide member connected to said elongated member, said first and second guide members engaging during movement of said pull member in said housing to assure uniform movement of said pull member in said housing.

12. A stiffening ring assembly according to claim 11 wherein:

said transmission system includes a spring biased pull member;

said connection assembly includes a yoke member having flexible arms operatively connecting the pull member to the supporting legs, and a housing having opposing walls for holding said yoke member; and an operating member connected to said pull member; and the arms of said yoke member are urged apart as the supporting legs assume the support position and the opposing walls of said housing diverging to enable the arms to move apart, and wherein the arms of said yoke member are urged together as the supporting legs assume the transport position, said opposing walls being narrowed in their separation to hold the arms together when the legs assume the transport position.

* * * * *